US008768215B2

(12) United States Patent
Miura

(10) Patent No.: US 8,768,215 B2
(45) Date of Patent: Jul. 1, 2014

(54) IMAGE FORMING APPARATUS

(75) Inventor: Shusuke Miura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/096,235

(22) Filed: Apr. 28, 2011

(65) Prior Publication Data

US 2011/0274470 A1 Nov. 10, 2011

(30) Foreign Application Priority Data

May 10, 2010 (JP) ..... 2010-108792

(51) Int. Cl.
*G03G 15/00* (2006.01)

(52) U.S. Cl.
USPC ..... 399/126; 399/113; 399/269

(58) Field of Classification Search
USPC ..... 399/113, 117, 119, 126, 167, 269
See application file for complete search history.

(56) References Cited

U.S. PATENT DOCUMENTS

| | | | | |
|---|---|---|---|---|
| 5,640,229 | A | 6/1997 | Nakahara | |
| 5,956,546 | A * | 9/1999 | Tsuchiya | 399/119 |
| 6,385,417 | B1 | 5/2002 | Tanaka et al. | |
| 6,735,410 | B2 | 5/2004 | Sekiguchi | |
| 7,333,746 | B2 | 2/2008 | Nagata et al. | |
| 8,078,084 | B2 | 12/2011 | Kamei et al. | |
| 2002/0181974 | A1 | 12/2002 | Sekiguchi | |
| 2006/0083541 | A1 | 4/2006 | Nagata et al. | |
| 2009/0123194 | A1 | 5/2009 | Hatano | |
| 2011/0249988 | A1 | 10/2011 | Miura | |

FOREIGN PATENT DOCUMENTS

| | | | |
|---|---|---|---|
| CN | 1760769 | A | 4/2006 |
| CN | 1959556 | A | 5/2007 |
| EP | 0 856 412 | B1 | 4/2001 |
| EP | 1 184 737 | A1 | 3/2002 |
| JP | 3289498 | B2 | 6/2002 |
| JP | 2002-351211 | A | 12/2002 |
| JP | 2002-357951 | A | 12/2002 |
| JP | 2003-149943 | A | 5/2003 |
| JP | 2008-191233 | A | 8/2008 |
| JP | 2009-271150 | A | 11/2009 |
| JP | 2009-276611 | A | 11/2009 |

OTHER PUBLICATIONS

Notification of Reason for Rejection mailed Jun. 28, 2011 (prepared on Jun. 20, 2011), in Japanese Application No. 2011-104482.

(Continued)

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes an supporting an image bearing member; a developing unit including first and second developer carrying members for developing an electrostatic latent image formed on the image baring member; first and second gap regulating members for regulating gaps between the image bearing member and the first and second developer carrying members, respectively; an urging member for urging the developing unit toward the image forming unit; and a positioning member for positioning the developing unit relative to the image forming unit. The positioning member includes a preventing portion for preventing, while permitting movement of the developing unit in a circumferential direction of the image bearing member at one longitudinal end of the developing unit, movement of the developing unit in the circumferential direction of the image bearing member at the other longitudinal end of the developing unit.

8 Claims, 20 Drawing Sheets

(56) References Cited

OTHER PUBLICATIONS

Notification of the First Office Action dated Dec. 19, 2012, in Chinese Application No. 201110119051.2.
Decision on Grant—A Patent for Invention dated Oct. 11, 2012, in Russian Application No. 2011118418/28 (027212).
Korean Notice of Allowance dated Oct. 7, 2013, in related Korean Patent Application No. 10-2011-0043415.

European Search Report dated Jan. 31, 2014, in related European Patent Application No. 11164890.3.

* cited by examiner

IMAGE FORMING APPARATUS

FIELD OF THE INVENTION AND RELATED ART

The present invention relates to an image forming apparatus in which a developing device including a plurality of developer carrying members is provided and a latent image formed on an image bearing member is developed by the developing device.

In a conventional image forming apparatus such as an electrophotographic copying machine, a method in which an electrostatic latent image formed on a surface of a photosensitive member is developed as a toner image by a developing device and the toner image is transferred onto a recording material (medium) such as a sheet, and then is fixed by a fixing means to obtain a recording image has been used.

Here, the developing device includes a developer carrying member (hereinafter referred to as a developing sleeve) and is disposed with a certain gap between the developing sleeve and the photosensitive member (hereinafter referred to as an SD gap). When a variation from a nominal value of the SD gap (SD gap error) is large, an amount of the toner for development on the photosensitive member is fluctuated, so that an image problem such as density non-uniformity occurs. As a means for maintaining the SD gap, an abutting roller method is generally used. In this method, the SD gap is determined by a difference between an outer diameter of a positioning member (abutting roller) provided coaxially with the developing sleeve and an outer diameter of the developing sleeve and is ensured by urging the developing sleeve toward the photosensitive member. There is also a method in which the contact of the abutting roller is effected by a supporting member for rotatably supporting the photosensitive member.

In recent years, with an improvement in productivity (speed-up) and image quality improvement of a copying machine or a printer, a developing device designed to be adaptable to the speed-up and the image quality improvement by providing two developing sleeves has been proposed. In this developing device, a first developing sleeve positioned at an upstream side in an image forming process and a second developing sleeve positioned at a downstream side of the first developing sleeve are mounted. At both ends of each of the two developing sleeves in the developing device, abutting rollers for ensuring the SD gap are provided. For example, in Japanese Laid-Open Patent Application (JP-A) 2002-351211 (claim 13 and FIG. 3), the first developing sleeve is rotatably fixed and supported by the developing device and the second developing sleeve is swingably shaft-supported with a rotational shaft (rotational axis) of the first developing sleeve as a center. Thus, the abutting rollers provided on the respective sleeves are configured to be independently urged toward a drum (photosensitive member).

Further, in JP-A 2008-191233 (claim 11 and FIG. 7), each of developing sleeves is fixed rotatably relative to a developing container. Further, abutting rollers provided at both ends of a second developing sleeve are abutted against a photosensitive member, so that a relative position between the second developing sleeve and the photosensitive member is determined. Thereafter, the developing container is rotated about an axis of the second developing sleeve to abut abutting rollers provided at both ends of a first developing sleeve against the photosensitive member, so that a relative position between the first developing sleeve and the photosensitive member is determined.

However, in either of constitutions of JP-A 2002-351211 and JP-A 2008-191233, there was the following problem.

That is, in the case where the rollers provided at the both ends of two or more developing sleeves are contacted to the drum, the abutting rollers are contacted to the drum at four or more points. However, in the conventional constitutions, the abutting rollers were urged in a state in which rotational axis directions of the developing sleeves and a rotational axis direction of the drum were parallel to each other and therefore by the influence of an alignment error between the twin sleeves, there arose a problem such that contact pressures of the four abutting rollers were not equal to each other. Here, the alignment error between the twin sleeves is an error in axial parallelism between a rotational axis of a first developing sleeve 14-1-1 and a rotational axis of a second developing sleeve 14-2-1 as shown in FIG. 16. When the SD gap is measured, in a state in which the developing device is contacted to the photosensitive member, the SD gap is measured at the following six points. That is, the SD gap between the first developing sleeve and the photosensitive member at a rear side, a central portion and a front side and the SD gap between the second developing sleeve and the photosensitive member at the rear side, the central portion and the front side are measured. For example, there are the case where the contact pressures of the front side first roller and the rear-side second roller are increased and the contact pressures of the front-side second roller and the rear-side first roller are increased, and its reverse case. Further, there is the case where one of the contact pressures of the four abutting rollers becomes small or one of the four abutting rollers is not abutted and is separated from the drum to result in the contact pressure of zero. In the case where the contact pressures are not equal to each other, amounts of deformation of the abutting rollers are fluctuated and thus the SD gap in the neighborhood of the abutting roller with a large amount of deformation is small and the SD gap in the neighborhood of the abutting roller with a small amount of deformation is large. As a result, the SD gap error becomes worse.

SUMMARY OF THE INVENTION

A principal object of the present invention is to provide an image forming apparatus which reduces a degree of image defect occurring due to a SD gap error resulting from an alignment error between twin sleeves.

According to an aspect of the present invention, there is provided an image forming apparatus comprising:

an image forming unit for rotatably supporting an image bearing member;

a developing unit including a first rotatable developer carrying member for developing an electrostatic latent image formed on the image baring member and a second rotatable developer carrying member for developing the electrostatic latent image formed on the image bearing member;

first gap regulating means, provided at both sides of the first rotatable developer carrying member, for regulating a gap between the image bearing member and the first rotatable developer carrying member;

second gap regulating means, provided at both sides of the second rotatable developer carrying member, for regulating a gap between the image bearing member and the second rotatable developer carrying member;

urging means for urging the developing unit toward the image forming unit so that the first gap regulating means and the second gap regulating means are urged against an abutment portion provided on the image bearing member; and positioning means for positioning the developing unit relative to the image forming unit, wherein the positioning means includes a preventing portion for preventing, while permitting movement of the developing unit in a circumferential direction of the image bearing member at one longitudinal end of the developing unit, movement of the developing unit in the circumferential direction of the image bearing member at the other longitudinal end of the developing unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment

An Embodiment according to the present invention will be described.

First, a constitution in this embodiment will be described and then positioning in this embodiment will be described. Finally, an effect in this embodiment will be shown.

First, the constitution in this embodiment will be described.

Figure 1:
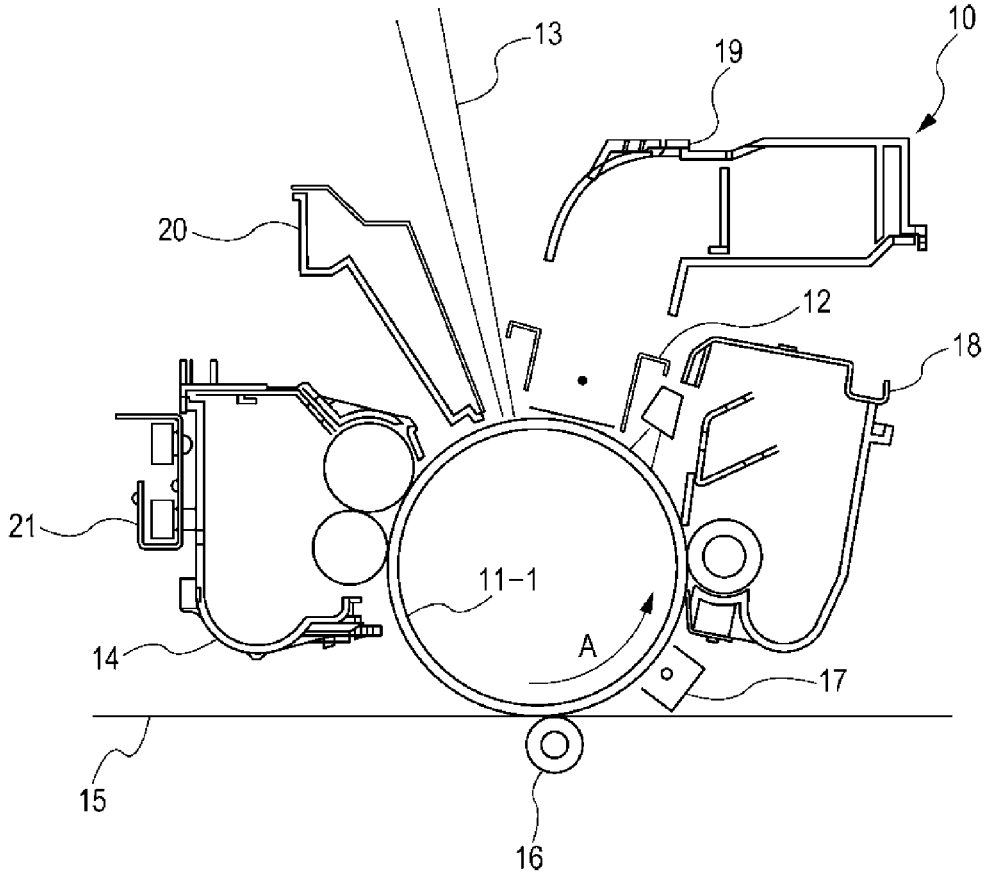
FIG. 1 is a sectional front view of an image forming portion.

FIG. 1 is a sectional view showing an image forming portion 10. A photosensitive drum 11-1 as an image bearing member is disposed at a central portion and is rotated in an arrow A direction during image formation. A charger 12, a laser optical path 13, a developing device 14, a transfer belt 15, a transfer roller 16, a discharging device 17 and a cleaning device 18 are successively disposed around the photosensitive drum 11 along the A direction. With respect to the charger 12, opposite from a drum unit 11 (the photosensitive drum 11-1), an air supplying duct 19 is disposed.

On a downstream side of the charger 12 with respect to the arrow A direction, an air exhausting duct 20 is disposed oppositely to the drum unit 11.

An image forming process will be described with reference to FIG. 1. The charger 12 electrically charges a surface of the rotating photosensitive drum 11-1. Then, laser light from a laser scanner (not shown) passes through the laser optical path 13 to write (form) an electrostatic latent image on the charged photosensitive drum surface. Next, the developing device 14 develops the electrostatic latent image on the photosensitive drum surface into a toner image. Then, onto the transfer belt 15 interposed between the photosensitive drum 11-1 and the transfer roller 16 to which a bias voltage has been applied, the toner image is transferred. Next, the discharging device 17 removes electric charge from the surface of the photosensitive drum 11-1. Then, the cleaning device 18 collects the toner remaining on the surface of the photosensitive drum 11-1 without being transferred. During the image forming process, air is supplied from the air supplying duct 19 to the charger 12 and is exhausted to the air exhausting duct 20.

[Drum Unit Constitution]

Figure 2:
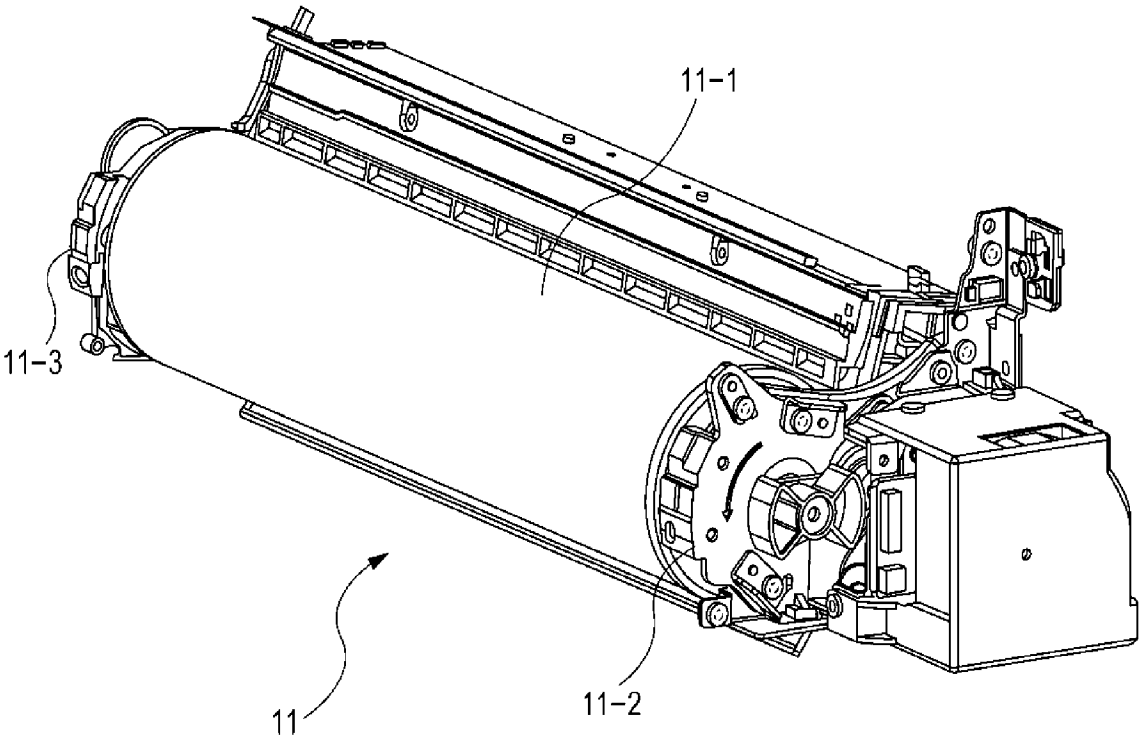
FIG. 2 is a perspective view of a drum unit.

FIG. 2 is a perspective view of the drum unit 11 as an image forming unit. The drum unit 11 includes the photosensitive drum 11-1, a positioning block (front side) 11-2 and a positioning block (rear side) 11-3. The positioning block (front side) 11-2 and a positioning block (rear side) 11-3 rotatably support the photosensitive drum 11-1.

Figure 3:
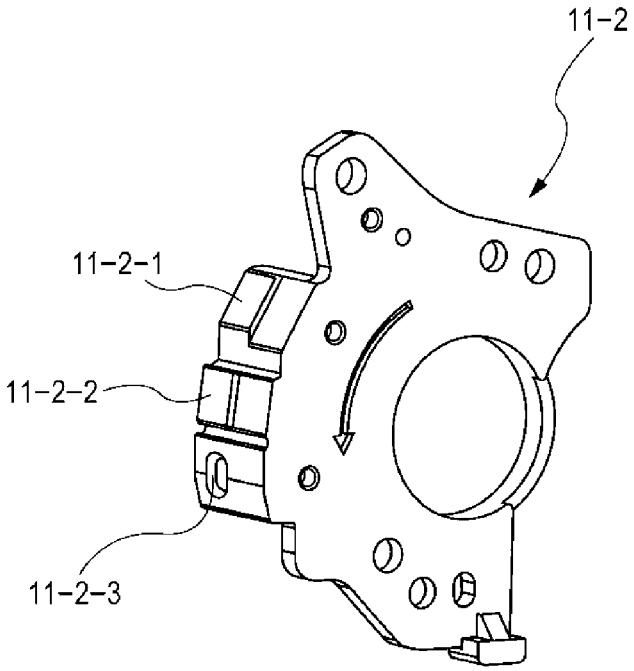
FIG. 3 is a perspective view of a front-side positioning block.

FIG. 3 is a perspective view of the positioning block (front side) 11-2. The positioning block (front side) 11-2 includes a first arcuate portion (front side) 11-2-1, a second arcuate portion (front side) 11-2-2 and a positioning hole (front side) 11-2-3. Here, the first arcuate portion (front side 11-2-1 and the second arcuate portion (front side) 11-2-2 are an arc with a rotational axis of the photosensitive drum 11-1 as a center. Further, the positioning hole (front side) 11-2-3 is an elongated circular hole with respect to a circumferential direction of the photosensitive drum 11-1.

Figure 4:
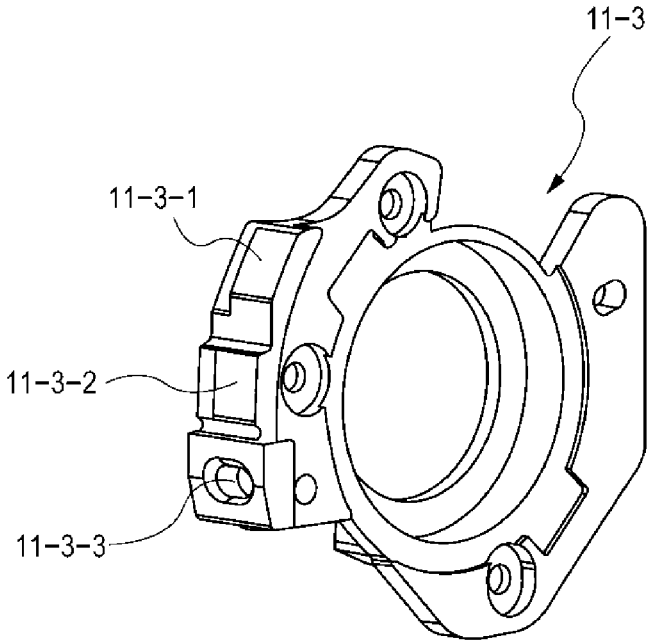
FIG. 4 is a perspective view of a rear-side positioning block.

FIG. 4 is a perspective view of the positioning block (rear side) 11-3. The positioning block (rear side) 11-3 includes a first arcuate portion (rear side) 11-3-1, a second arcuate portion (rear side) 11-3-2 and a positioning hole (rear side) 11-3-3. Here, the first arcuate portion (rear side 11-3-1 and the second arcuate portion (rear side) 11-3-2 are an arc with the rotational axis of the photosensitive drum 11-1 as a center. Further, the positioning hole (rear side) 11-3-3 is an elongated circular hole with respect to the rotational axis direction of the photosensitive drum 11-1.

[Developing Unit Constitution]

Figure 5:
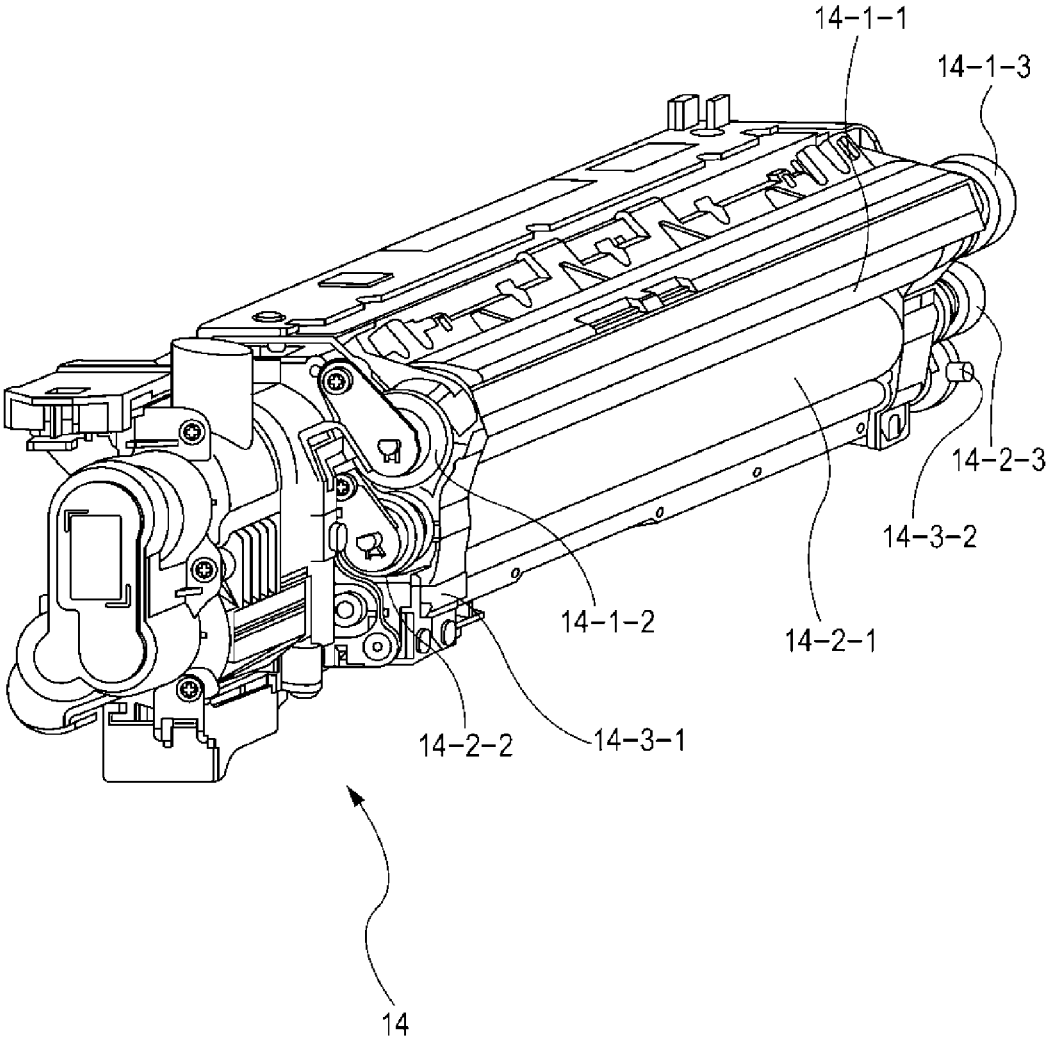
FIG. 5 is a perspective view of a developing device.
Figure 6:
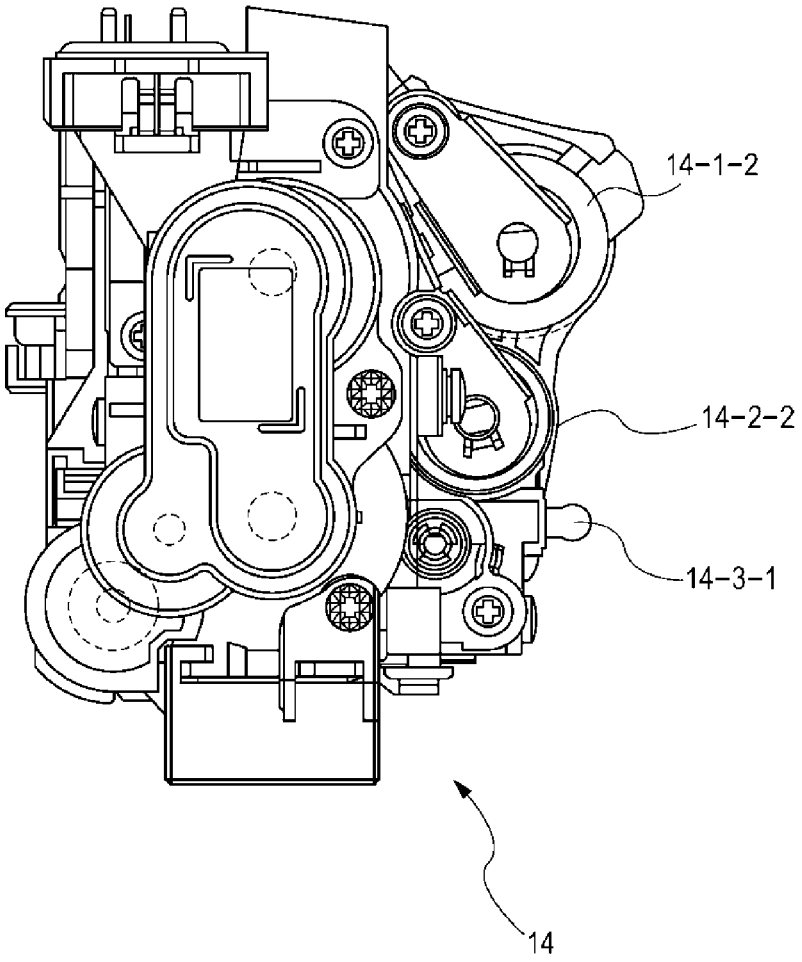
FIG. 6 is a front view of the developing device.
Figure 7:
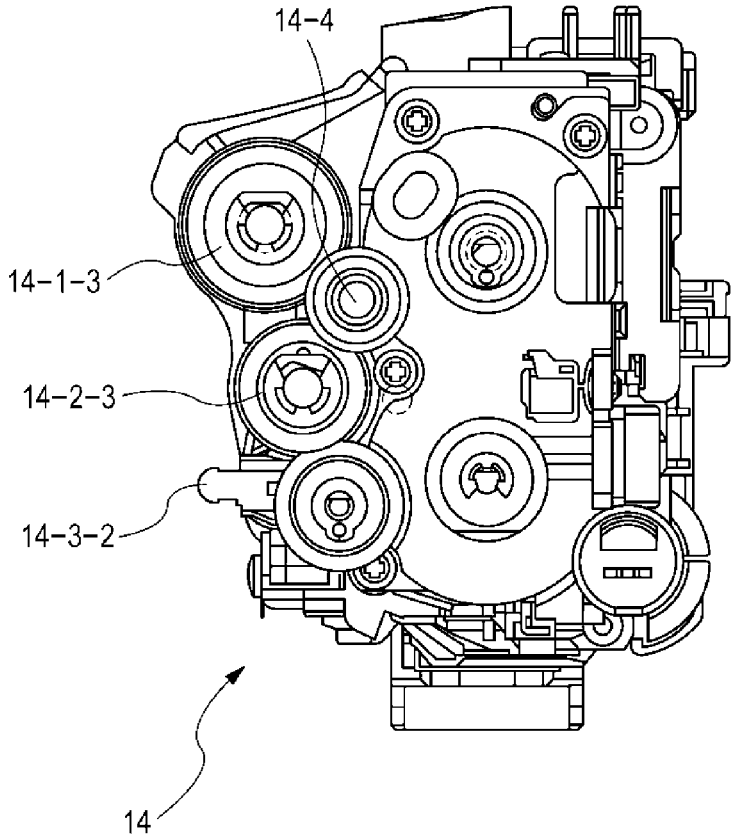
FIG. 7 is a rear view of the developing device.

FIGS. 5, 6 and 7 are a perspective view, a front view and a rear view, respectively, of the developing device 14. The developing device 14 includes an upper sleeve 14-1-1 as a first developer carrying member and includes an upper sleeve abutting roller (front side) 14-1-2 and an upper sleeve abutting roller (rear side) 14-1-3 which are used as a first positioning member. Further, the developing device 14 includes a lower sleeve 14-2-1 as a second developer carrying member and includes a lower sleeve abutting roller (front side) 14-2-2 and a lower sleeve abutting roller (rear side) 14-2-3 which are used as a second positioning member.

Further, the developing device 14 includes a positioning pin (front side) 14-3-1 and a positioning pin (rear side) 14-3-2. Here, the rotational axis of the upper sleeve abutting roller (front side) 14-1-2 and the rotational axis of the upper sleeve abutting roller (rear side) 14-1-3 are disposed on the rotational axis 14-1-1 at both sides of the upper sleeve 14-1-1. Here, the rotational axis of the lower sleeve abutting roller (front side) 14-2-2 and the rotational axis of the lower sleeve abutting roller (rear side) 14-2-3 are disposed on the rotational axis of the lower sleeve 14-2-1. Here, the positioning pin (front side) 14-3-1 and the positioning pin (rear side) 14-3-2 have a spherical end.

Each of the upper sleeve 14-1-1 and the lower sleeve 14-2-1 is provided so as to be rotatably fixed positionally, so that a distance between the upper sleeve and the lower sleeve is ensured.

Figure 20:
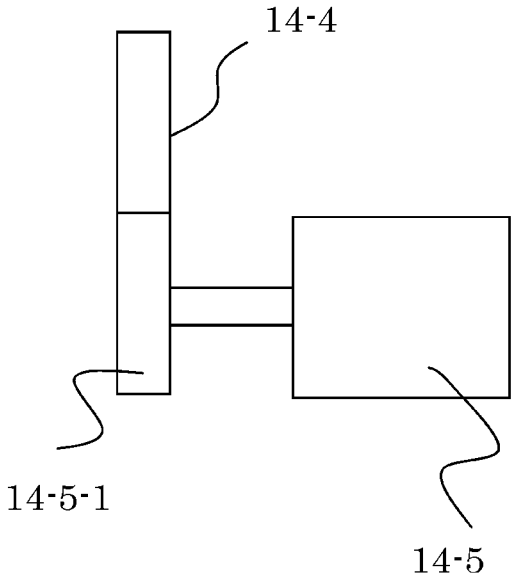
FIG. 20 is a schematic view for illustrating drive transmission to a driving gear.

As shown in FIG. 7, at a rear-side end portion of the developing device 14, a driving gear 14-4 for driving the developing device 14 is provided. In this embodiment, the driving gear 14-4 drives the upper sleeve 14-1-1 and the lower sleeve 14-2-1 and drives a screw, provided in the developing device 14, for stirring and feeding a developer. As shown in FIG. 20, the driving gear 14-4 is driven by transmitting thereto a driving force from a driving source 14-5 provided at a main assembly side. Further, the driving gear 14-4 is configured so that the driving force is transmitted thereto by being engaged with a driving gear 14-5-1, provided at the main assembly side, driven by drive the driving source 14-5.

Figure 8:
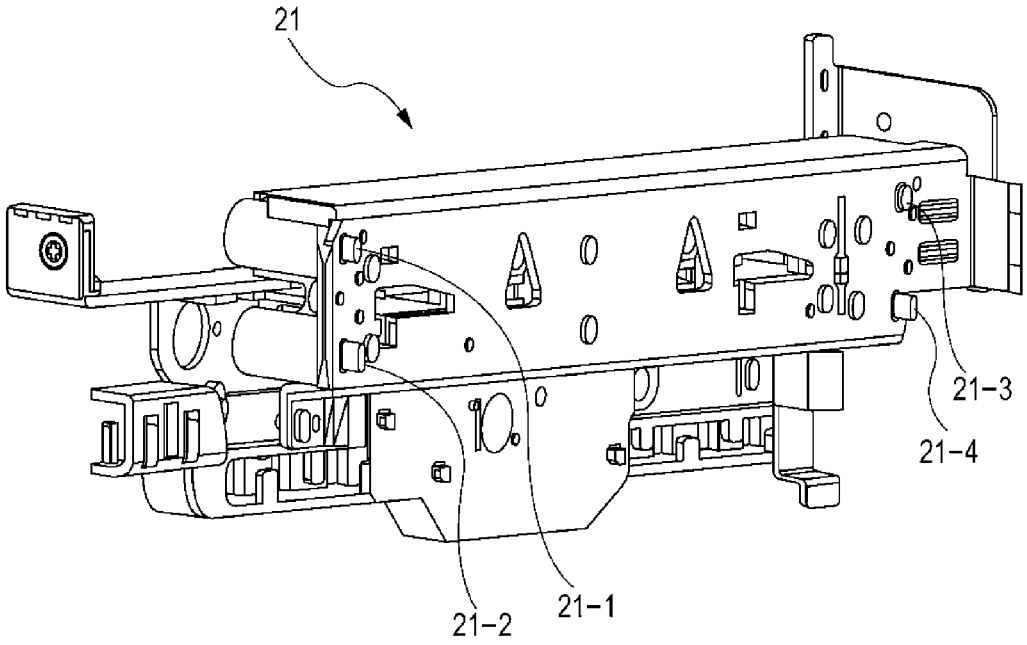
FIG. 8 is a perspective view of an urging unit.

FIG. 8 is a perspective view of an urging unit 21. The urging unit 21 includes an urging pin (upper-front side) 21-1, an urging pin (lower-front side) 21-2, an urging pin (upper-rear side) 21-3 and an urging pin (lower-rear side) 21-4.

Next, the positioning will be described.

Figure 9:
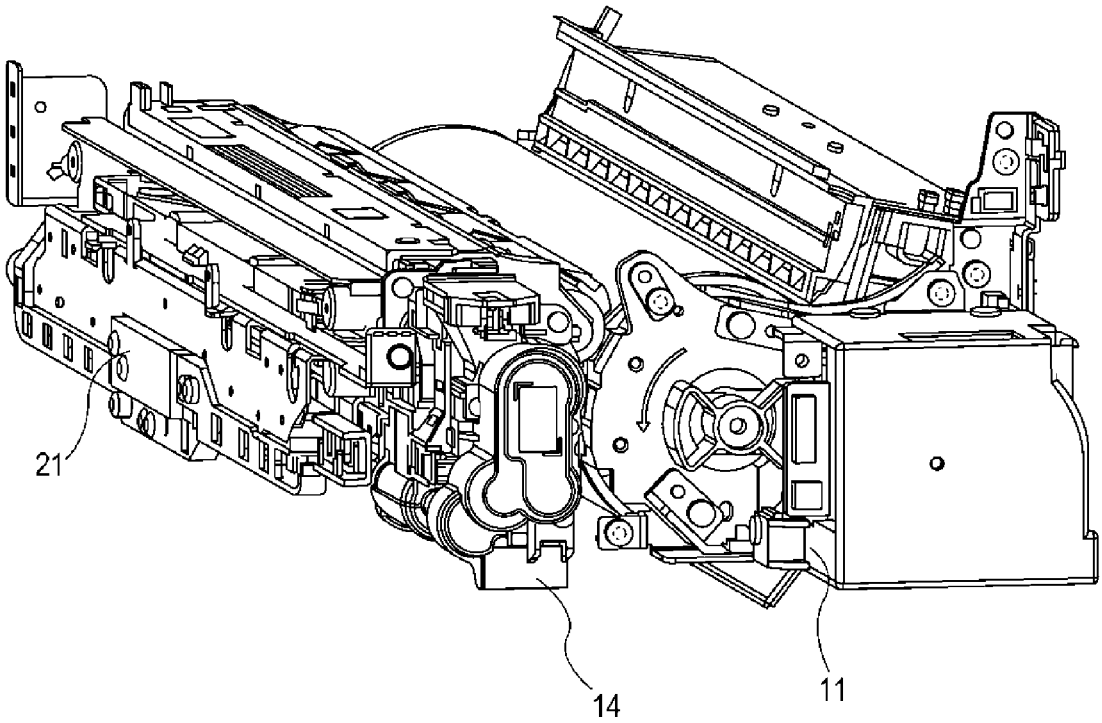
FIG. 9 is a perspective view of the drum unit, the urging unit and the developing device.

FIG. 9 is a perspective view of the drum unit 11, the developing device 14 and the urging unit 21 which are in an assembled state.

A method for determining relative position between the drum unit 11 and the developing device 14 will be described. The drum unit 11 and the developing device 14 are initially separated from each other. The developing device 14 is urged toward the drum unit 11 by the urging unit 21, so that the developing device 14 is moved toward the drum unit 11.

A shape of the positioning hole (front side) 11-2-3 as a positioning means is an elongated circular hole shape extending in the circumferential direction of the photosensitive drum 11-1. For this reason, the positioning hole (front side) 11-2-3 as a first hole and the positioning pin (front side) 14-3-1 as a first pin are engaged with each other, so that a relative position between the drum unit 11 and the developing device 14 with respect to a front-rear direction (axial direction of the drum) is determined. At this time, the positioning pin (front side) 14-3-1 is regulated by the positioning hole (front side) 11-2-3 so as to be movable in the circumferential direction of the drum. Here, each of the positioning hole (front side) 11-2-3 and the positioning pin (front side) 14-3-1 functions as the positioning means.

A shape of the positioning hole (rear side) 11-3-3 as a positioning means is an elongated circular hole shape extending in the rotational axis direction of the photosensitive drum 11-1. For this reason, the positioning hole (rear side) 11-3-3 as a second hole and the positioning pin (rear side) 14-3-2 as a second pin are engaged with each other, so that a relative position between the drum unit 11 and the developing device 14 with respect to the circumferential direction is determined. That is, the positioning hole (rear side) 11-3-3 and the positioning pin (rear side) 14-3-2 function as a circumferential direction movement preventing portion for preventing movement of the developing device 14 in the circumferential direction of the photosensitive drum 11-1. At this time, the positioning pin (rear side) 14-3-2 is regulated by the positioning hole (rear side) 11-3-3 so as to be movable in the axial direction of the drum.

The positioning hole (rear side) 11-3-3 and the positioning hole (front side) 11-2-3 are regulating portions for regulating the positioning pin (rear side) 14-3-2 and the positioning pin (front side) 14-3-1. These regulating portions regulate, when the developing device 14 is positioned relative to the drum unit 11, the developing device 14 so that one end side of the developing device 14 constitutes a rotation center and the other end side of the developing device 14 can be rotated relative to the one end side of the developing device 14.

The second arcuate portion (rear side) 11-3-2 and the lower sleeve abutting roller (rear side) 14-2-3 are contacted to each other (lower-rear side contact portion) and the second arcuate portion (front side) 11-2-2 and the lower sleeve abutting roller (front side) 14-2-2 are contacted to each other (lower-front side contact portion), so that a distance (gap) between the lower sleeve 14-2-1 and the photosensitive drum 11-1 is determined.

FIGS. 10 to 15 show a change in attitude of the developing device 14 with respect to an arrow B direction or an arrow C direction when an urging force (pressure) is gradually increased. Incidentally, the roller shapes in these figures are illustrated for facilitating understanding by exaggeratedly showing an amount of roller deformation.

Figure 10:
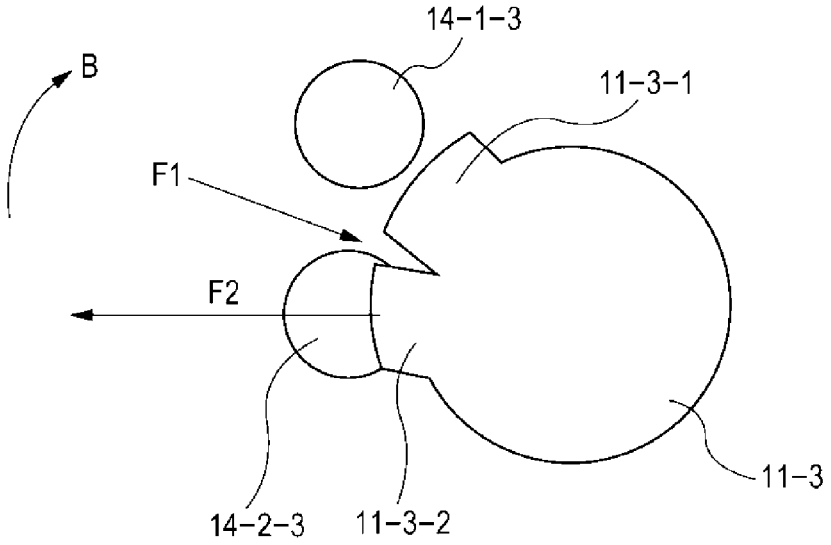
FIGS. 10, 11 and 12 are schematic views for illustrating rear-side positioning.

When the urging force is increased, a contact pressure arcuate portion (rear side) 11-3-2 and the lower sleeve abutting roller (rear side) 14-2-3 becomes large (FIG. 10).

Figure 13:
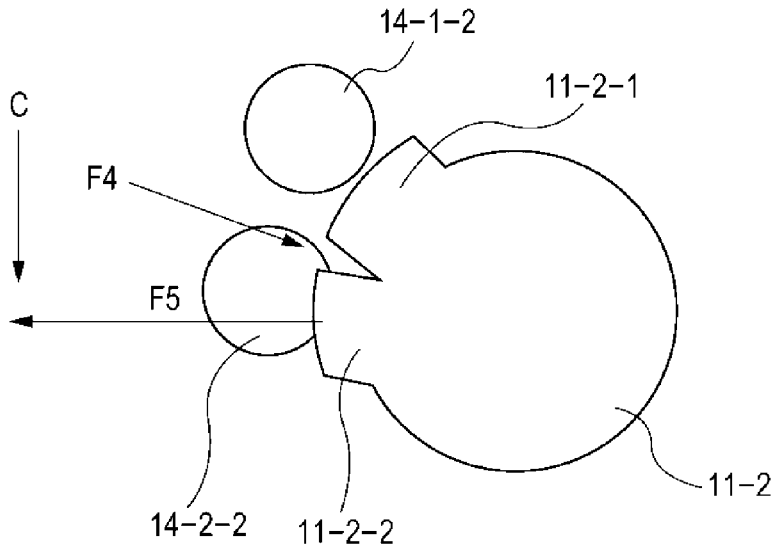
FIGS. 13, 14 and 15 are schematic views for illustrating front-side positioning.

When the urging force is increased, a contact pressure between the second arcuate portion (front side) 11-2-2 and the lower sleeve abutting roller (front side) 14-2-2 becomes large (FIG. 13).

Here, each of F1 and F4 represents resultant force of the urging force by the urging unit 21 and the force of gravity received by the developing device 14.

As shown in FIG. 10, F2 represents reaction force received by the developing device 14 by the contact between the second arcuate portion (rear side) 11-3-2 and the lower sleeve abutting roller (rear side) 14-2-3.

As shown in FIG. 13, F5 represents reaction force received by the developing device 14 by the contact between the second arcuate portion (front side) 11-2-2 and the lower sleeve abutting roller (front side) 14-2-2.

Figure 11:
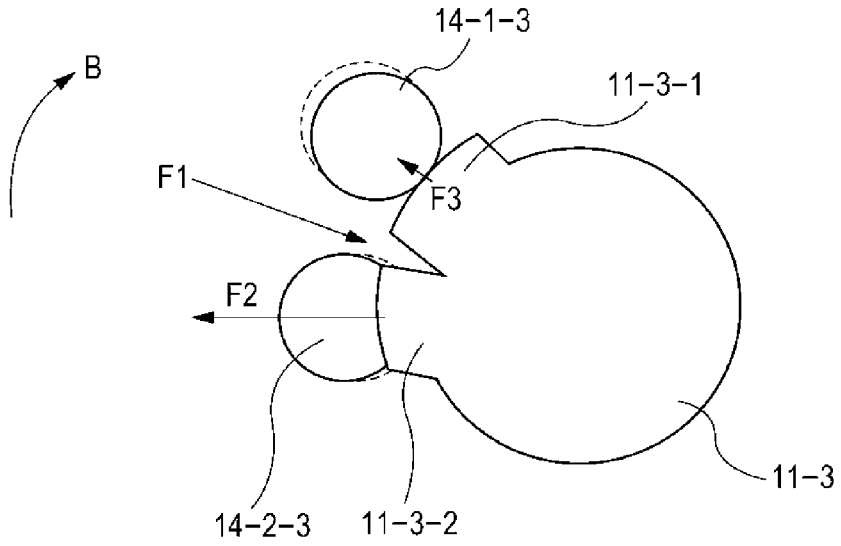

As shown in FIGS. 10 and 11, by resultant force of F1 and F2, the developing device 14 is rotated (in the B direction) about the rotational axis of the lower sleeve 14-2-1, so that the first arcuate portion (rear side) 11-3-1 and the upper sleeve arcuate portion (rear side) 14-1-3 are contacted (upper-rear side contact portion).

Figure 17:
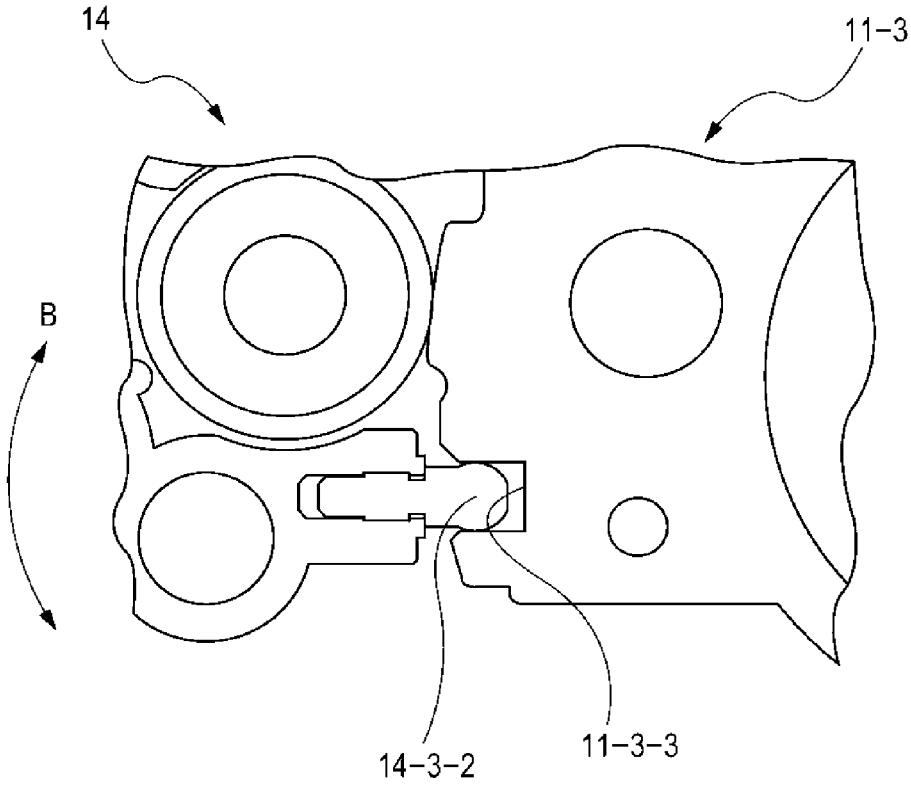
FIG. 17 is a sectional front view of a rear-side positioning portion.

Here, as shown in FIG. 17, the end of the positioning pin (rear side) 13-3-2 is spherical and therefore the influence of the engagement between the positioning hole (rear side) 11-3-3 and the positioning pin (rear side) 14-3-2 on the rotation of the developing device in the B direction is slight.

Figure 14:
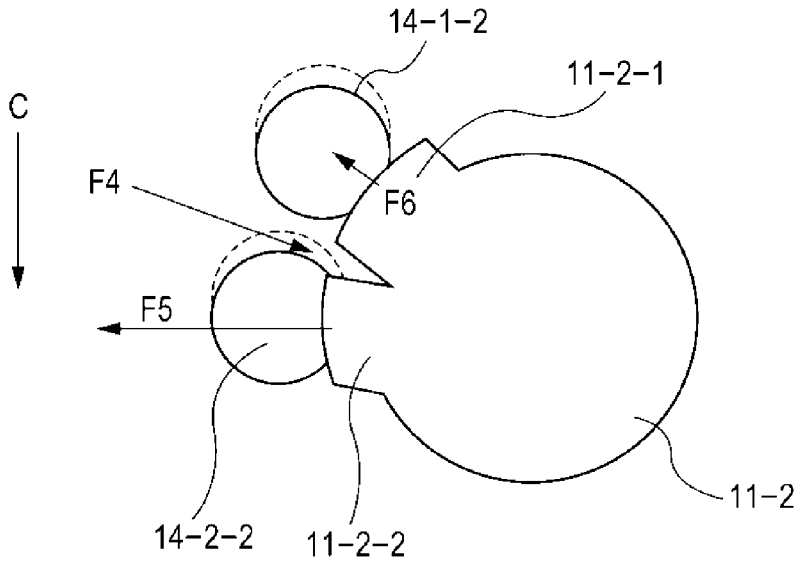

By resultant force of F4 and F5, the developing device 14 is rotated (in the C direction) about the positioning pin (rear side) 14-3-2, so that the first arcuate portion (front side) 11-2-1 and the upper sleeve arcuate portion (front side) 14-1-2 are contacted (upper-front side contact portion) (FIG. 14).

Figure 18:
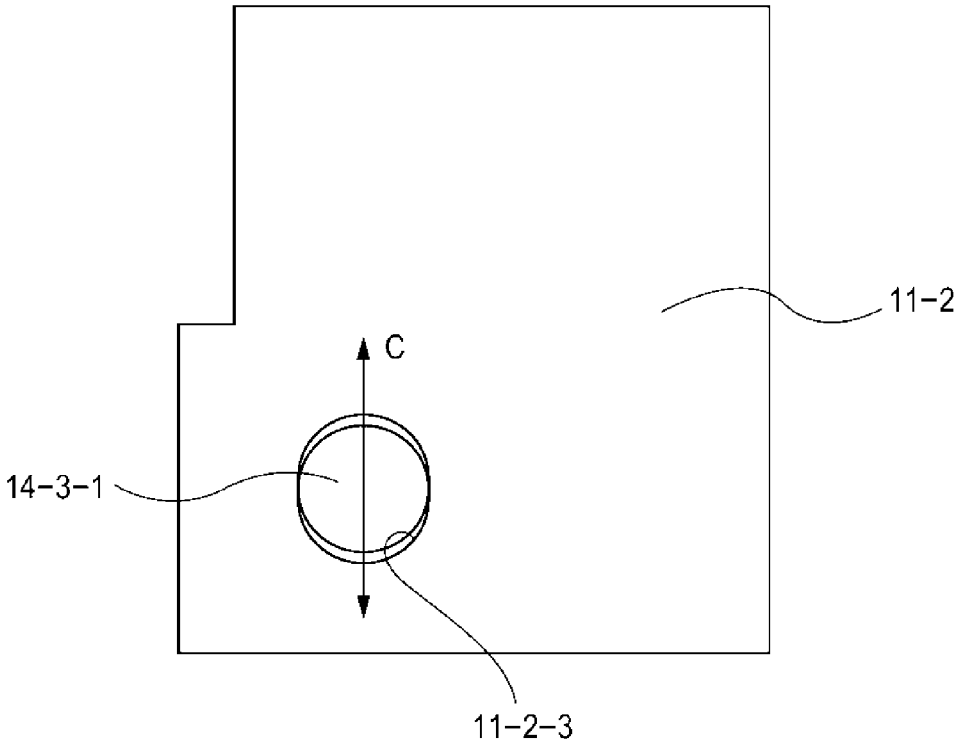
FIG. 18 is a left-side sectional view of a front-side positioning portion.

Here, the positioning hole (front side) 11-2-3 is the elongated circular hole with respect to the circumferential direction of the photosensitive drum 11-1 and therefore the influence of the engagement between the positioning hole (front side) 11-2-3 and the positioning pin (front side) 14-3-1 on the rotation of the developing device in the B direction is slight (FIG. 18). Similarly, the positioning hole (rear side) 11-3-3 is the elongated circular hole with respect to the rotational axis direction of the photosensitive drum 11-1 and therefore the influence thereof on the rotation of the developing device in the C direction is slight.

F3 represents reaction force received by the developing device 14 by the contact between the first arcuate portion (rear side) 11-3-1 and the upper sleeve abutting roller (rear side) 14-1-3.

F6 represents reaction force received by the developing device 14 by the contact between the first arcuate portion (front side) 11-2-1 and the upper sleeve abutting roller (front side) 14-1-2.

When the urging force is further increased and thus reaches 4.7 kgf which is nominal urging force of the urging unit 21, the four urging pins of the urging unit 21 are se so that the center of the photosensitive drum is located on the lines of action of F1 and F4.

Figure 12:
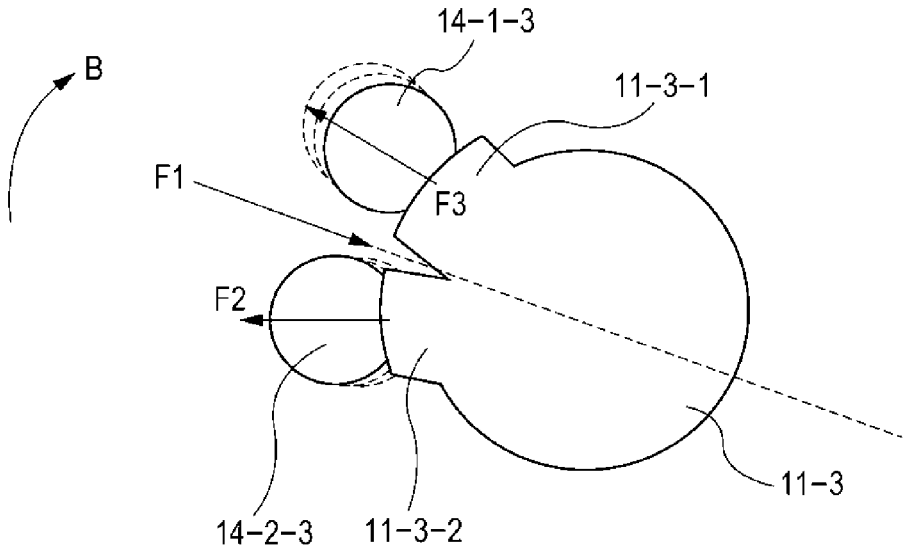

In the case where there is a difference between F2 and F3, the difference is a moment for rotating the developing device 14 in the B direction and thus the developing device 14 is rotated slightly in the B direction, with the result that magnitudes of F2 and F3 are equal to each other (FIG. 12).

Figure 15:
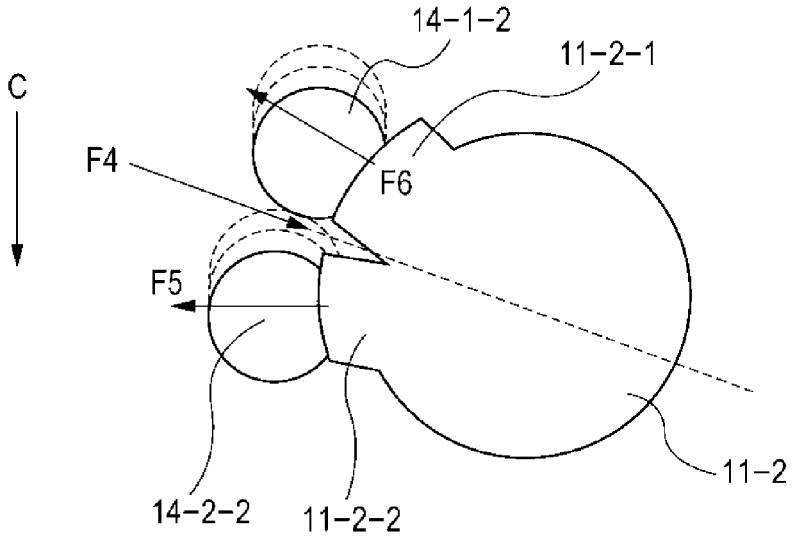
Figure 16:
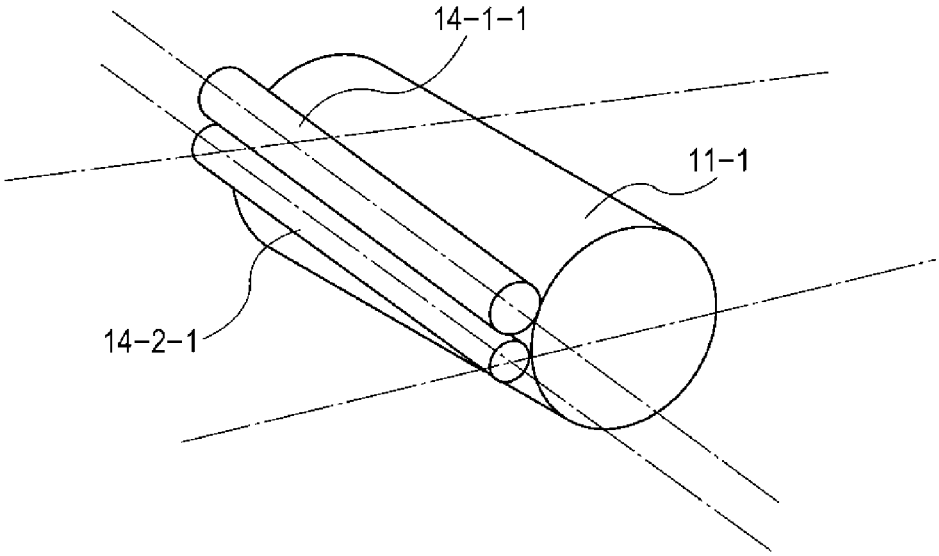
FIG. 16 is a perspective view of a drum and upper and lower sleeves.

In the case where there is a difference between F5 and F6, the difference is a moment for rotating the developing device 14 in the C direction and thus the developing device 14 is rotated slightly in the C direction, with the result that magnitudes of F5 and F6 are equal to each other (FIG. 15). Based on the constitution described above, it is possible to reduce the adverse influence of the alignment error between the twin sleeves on the SD gap error by the image forming apparatus in which the positioning of the developing device 14 relative to the drum unit 11 is effected.

Incidentally, in this embodiment, the position of the driving gear for driving the developing device 14 and the position of the positioning hole (rear side) 11-3-3 for preventing the movement of the developing device 14 in the circumferential direction of the photosensitive drum are provided at the same side with respect to the rotational axis direction of the developing sleeve. As a result, in the constitution in which the alignment error between the twin sleeves is reduced by rotating the developing device 14, it is possible to minimize a deviation of the engagement between the driving gear of the developing device 14 and the main assembly-side driving gear (misalignment between the respective rotational axes).

Finally, the effect in this embodiment will be described.

The case where the position of the upper sleeve abutting roller (front side) 14-1-2 is deviated from the nominal position by 100 μm in a direction in which the upper sleeve abutting roller (front side) 14-1-2 is separated from the first arcuate portion (front side) 11-2-1 will be studied. In this case, the influences of a conventional constitution and the constitution in this embodiment on the SD gap error are described below.

Figure 19:
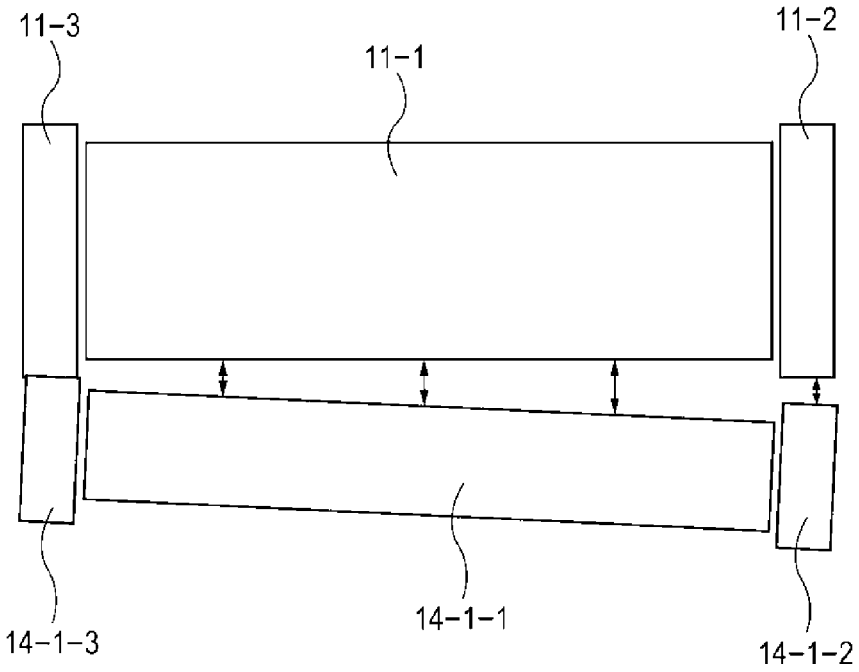
FIG. 19 is a top plan view when an SD gap error occurs.

In the case of the conventional constitution, before the urging by the urging unit 21, the distance between the first arcuate portion (front side) 11-2-1 and the upper sleeve abutting roller (front side) is 100 μm. For this reason, the SD gap between the upper sleeve 14-1-1 and the photosensitive drum 11-1 is, on the basis of a nominal value before the urging, +75 μm at the front side (upper-front side SD gap), +50 μm at the central portion (upper-central SD gap) and +25 μm at the rear side (upper-rear side SD gap) (FIG. 19). The SD gap between the lower sleeve 14-2-1 and the photosensitive drum 11-1 is the nominal value at each of the front side (lower-front side SD gap), the central portion (lower-central SD gap) and the rear side (lower-rear side SD gap).

From this state, nominal urging by the urging unit 21 is performed. By the urging, the developing device 14 is distorted to contact the four contact portions to the photosensitive drum. However, the contact pressures are different from each other at the four contact portions and the amounts of roller deformation are also different from each other at the four contact portions. Each roller is deformed in the amount of 100 μm under pressure of 1 kgf. In this case, the contact pressures at the upper-front side contact portion and the lower-rear side contact portion are 0.5 kgf and the contact pressures at the upper-rear side contact portion and the lower-front side contact portion are 1.5 kgf. In the case where the contact pressures at the four contact portions are equal to each other, the deformation amount is 100 μm and therefore the nominal SD gap during the urging is smaller than that before the urging by 100 μm. Finally, the SD gap is, on the basis of the nominal value during the urging, +50 μm at the upper-front side, ±0 μm at the upper-central portion, −50 μm at the upper-rear side, −50 μm at the lower-front side, ±0 μm at the lower-central portion and +50 μm at the lower-rear side.

In the case of the constitution in this embodiment, before the urging by the urging unit 21, the position of the developing device 14 is not determined. By the urging, the developing device 14 is slightly rotated in the B direction until the contact pressures at the upper-rear side contact portion and the lower-rear side contact portion become 1 kgf. At this time, when the developing device 14 is not rotated in the C direction, at the upper-front side contact portion, the gap of 100 μm is generated. From this state, the developing device 14 is rotated in the C direction until the contact pressures at the upper-front side contact portion and the lower-front side contact portion are equal to each other. When these contact pressures are equal to each other, the roller deformation amounts at the upper- and lower-front side contact portions are equal to each other, so that the associated distances between the rollers and the positioning blocks are equal to each other. By the rotation of the developing device 14 in the C direction by 238.4 μm, these distances between the rollers and the positioning blocks are equal to each other, so that the contact pressures at the upper- and lower-front side contact portions are equal to each other. At this time, the upper sleeve 14-1-1 and the lower sleeve 14-2-1 are misaligned with the photosensitive drum 11-1, so that the upper-central SD gap and the lower-central SD gap are small. However, the influence of the misalignment is 0.13 μm which is very small. Finally, the SD gap is, on the basis of the nominal value during the urging, −0.065 μm at the upper-front side, −0.13 μm at the upper-central portion, −0.065 μm at the upper-rear side, −0.065 μm at the lower-front side, −0.13 μm at the lower-central portion and −0.065 μm at the lower-rear side.

Further, even in the case where defective parts which provide a very large alignment error between twin sleeves are used, the photosensitive drum 11-1 is not contacted to the upper sleeve 14-1-1 and the lower sleeve 14-2-1 to cause damage. In the following, the case where the alignment error between twin sleeves is 10 mm will be described as an example.

The positioning hole (front side) 11-2-3 is the elongated circular hole of 4.6 mm×5.6 mm, so that the developing device 14 can only be rotated in the C direction in a distance of ±0.5 mm. That is, the rotation amount of the developing device 14 is regulated. In the case where the defective parts which provide the alignment error of 10 mm are used, the positioning pin (front side) 14-3-1 abuts against an upper end or lower end of the positioning hole (front side) 11-2-3. At this time, the SD gap is 0.572 μm. The nominal value of the SD gap is 270 μm and therefore there is no possibility that the positioning pin and hole are contacted to each other.

Incidentally, in this embodiment, the positioning of the positioning holes to be engaged with the positioning pins is effected by shaping one positioning hole in the elongated hole extending in the drum axis direction and by shaping the other positioning hole in the elongated hole extending in the circumferential direction of the drum but the present invention is not limited thereto. For example, one positioning hole is shaped in a circular hole substantially equal to a diameter of the positioning pin in order to position the positioning pin with respect to the circumferential direction and the axial direction of the drum. On the other hand, the other (end side) positioning hole is shaped in a diameter which is larger than that of the positioning pin with a clearance. Thus, the other (end side) positioning pin may also be configured to be rotatable about the one (end side) positioning pin at the rotation center.

Further, in this embodiment, an example in which the pins are provided at the developing unit side and the holes are provided at the drum unit side is described but the present invention is not limited thereto. That is, the pins may also be provided at the drum unit side and the holes may also be provided on the developing unit side.

Further, even when the constitution of the pins and the holes is not the constitution in which the pins are inserted into the holes, any constitution can be employed so long as the constitution can regulate the developing unit and the drum unit.

Further, it is also possible to employ a technique, such that the sleeve abutting rollers are contacted to the position, in the present invention. Further, a constitution in which the rollers are provided coaxially with the drum at the end portions of the drum and to which the end portions of the sleeves themselves or abutment surfaces provided on the developing unit are contacted may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 108792/2010 filed May 10, 2010, which is hereby incorporated by reference.

What is claimed is:

1. An image forming apparatus comprising:

an image forming unit, including a rotatably supported image bearing member;

a developing unit including a first rotatable developer carrying member for developing an electrostatic latent image formed on the image bearing member and a second rotatable developer carrying member for developing the electrostatic latent image formed on the image bearing member, first gap regulating member, provided at both ends of the first rotatable developer carrying member, for regulating a gap between the image bearing member and the first rotatable developer carrying member;

second gap regulating member, provided at both ends of the second rotatable developer carrying member, for regulating a gap between the image bearing member and the second rotatable developer carrying member;

urging means for urging said developing unit toward said image forming unit; and a positioning unit for positioning said developing unit relative to said image forming unit, wherein said positioning unit includes a preventing portion for preventing, while permitting movement of said developing unit in a circumferential direction of the image bearing member at a first longitudinal end of said developing unit, movement of said developing unit in the circumferential direction of the image bearing member at a second longitudinal end of said developing unit.

2. An image forming apparatus according to claim 1, further comprising a driving gear for driving said developing unit, wherein said driving gear is driven by a driving source provided at a main assembly side of said image forming apparatus and is provided at the second longitudinal end of said developing unit.

3. An image forming apparatus according to claim 1 or 2, wherein said positioning unit includes a first pin provided in the first longitudinal end of said developing unit, and the preventing portion includes a first hole, to be engaged with the first pin, provided to said image forming unit, and wherein a shape of the first hole is an elongated hole elongated in the circumferential direction of the image bearing member so that the first hole can prevent movement of the first pin in an axial direction of the image bearing member and so that the first pin is movable in the circumferential direction of the image bearing member.

4. An image forming apparatus according to claim 1 or 2, wherein said positioning unit includes a second pin provided in the second longitudinal end of said developing unit, and the preventing portion includes a second hole, to be engaged with the second pin, provided to said image forming unit, and wherein a shape of the second hole is an elongated hole elongated in an axial direction of the image bearing member so that the second hole can prevent movement of the second pin in the circumferential direction of the image bearing member and so that the second pin is movable in the axial direction of the image bearing member.

5. An image forming apparatus according to claim 1 or 2, wherein when the first longitudinal end of said developing unit is rotationally moved relative to the second longitudinal end of said developing unit, said positioning unit regulates an amount of rotation of said developing unit so that the first developer carrying member and the second developer carrying member are prevented from being contacted with the image bearing member.

6. An image forming apparatus according to claim 1 or 2, wherein said positioning unit includes a first pin provided in the second longitudinal end of said image forming unit, and the preventing portion includes a first hole, to be engaged with the first pin, provided to said developing unit, and wherein a shape of the first hole is an elongated hole elongated in the circumferential direction of the image bearing member so that the first hole can prevent movement of the first pin in an axial direction of the image bearing member and so that the first pin is movable in the circumferential direction of the image bearing member.

7. An image forming apparatus according to claim 1 or 2, wherein said positioning unit includes a second pin provided in the second longitudinal end of said image forming unit, and the preventing portion includes a second hole, to be engaged with the second pin, provided to said developing unit, and wherein a shape of the second hole is an elongated hole elongated in an axial direction of the image bearing member so that the second hole can prevent movement of the second pin in the circumferential direction of the image bearing member and so that the second pin is movable in the axial direction of the image bearing member.

8. An image forming apparatus according to claim 1, further comprising a supporting portion for supporting the image bearing member, wherein said first gap regulating member and said second gap regulating member abut against the supporting portion.

* * * * *